United States Patent [19]

Argoudelis

[11] 4,008,450

[45] Feb. 15, 1977

[54] TUNABLE COIL ASSEMBLY

[76] Inventor: Evangelos Argoudelis, Northbrook, Ill.

[73] Assignee: Filtech Corporation, Elk Grove, Ill.

[22] Filed: May 30, 1975

[21] Appl. No.: 582,273

[52] U.S. Cl. ..... 336/132; 336/136

[51] Int. Cl.[2] ..... H01F 21/06

[58] Field of Search ..... 336/130, 132, 133, 134, 336/135, 136, 110; 323/90

[56] References Cited

UNITED STATES PATENTS

| | | | |
|---|---|---|---|
| 1,896,510 | 2/1933 | Given | 336/135 X |
| 2,154,232 | 4/1939 | Darnell | 336/134 |
| 2,163,448 | 6/1939 | Otto | 336/134 |
| 2,899,631 | 8/1959 | Cushman | 336/134 X |
| 2,899,654 | 8/1959 | Geiser | 336/110 |
| 3,100,882 | 8/1963 | Burnell | 336/110 X |
| 3,258,726 | 6/1966 | Hellmann | 336/110 |
| 3,471,815 | 10/1969 | Grant et al. | 336/136 X |
| 3,517,363 | 6/1970 | Curtis et al. | 336/136 |
| 3,518,595 | 6/1970 | Dawson et al. | 336/134 |

FOREIGN PATENTS OR APPLICATIONS

| | | | |
|---|---|---|---|
| 6,950 | 5/1956 | Germany | 336/132 |
| 605,114 | 7/1948 | United Kingdom | 336/134 |
| 875,468 | 8/1961 | United Kingdom | 336/132 |

*Primary Examiner*—Thomas J. Kozma

[57] ABSTRACT

A tunable coil assembly including a toroid or ring core and a variable cylindrical core means attached to the toroid core. The variable core means includes a slug movable within an electrically insulative coil form or holder. A turn(s) of electrically conductive wire is wound around both the toroid core and the adjustable core means. Another turn(s) of the wire may be wound around only the toroid core.

18 Claims, 7 Drawing Figures

TUNABLE COIL ASSEMBLY

BACKGROUND OF THE INVENTION

This invention relates generally to an inductive coil for use in electrical circuits, and more specifically relates to a tunable coil wound around a core, and still more specifically relates to a tunable coil assembly including turns of the coil wound around a toroid core and a variable cylindrical core.

Electrical filters are used to pass or reject a band of frequencies, or may be designed to pass frequencies below a designated frequency ("low pass") or pass frequencies above a designated frequency ("high pass"). Various electrical networks may be used to provide the desired frequency response, such as for example, the simple L-C (inductance-capacitance) section. A plurality of L-C sections may be cascaded together to increase selectivity and sharpness of the response curve.

The inductors for the filters may be air coils, either self supported or coils wound on electrically insulated coil forms (such as ceramic or glass). Iron-core coils or ferrite-core coils may also be used. The iron-cores are generally powdered iron or laminated iron or steel. If the coils are wound on a ring shape instead of a cylindrical form, they are referred to as toroids. Toroids are characterized by their relatively high Q, and special shape of the generated magnetic field.

In order to adjust the inductance or peak or set the response curve of the tuned circuit, variable coils or variable capacitors are used. The variable coils are generally wound on a hollow cylindrical form with a ferrite, powdered iron or brass core movable inside the cylindrical form. The core may be threaded and incrementally movable along internal threads formed inside the cylindrical form. The variable coil may constitute the entire inductive part of a tuned circuit, but usually is in series with a fixed inductor.

When designing a sharp response or narrow band electrical filter, the Q or quality factor of the circuit is a key consideration. Q may be defined as the ratio of the resonant frequency to the bandwidth of the frequency response curve at the 3 db points, or Q equals ($fo/f1$ minus $f2$). Therefore, as the bandwidth of the filter is increased, the Q is decreased, but as the bandwidth is narrowed the Q is increased.

The Q or quality factor of the coil is commonly defined as the ratio of the reactance of the coil and its DC resistance, and is therefore, dependent upon frequency. When using a variable coil, alone or with a fixed coil, the Q usually varies over the range of adjustment of the variable coil.

In many instances, when a sharp or narrow band response is required, the Q must be maintained within tight and exact tolerances. Thus, to prevent any degradation of the Q when setting the resonant frequency, particularly in the MegaHertz range, it is a common practice to cut or file the capacitor in the capacitance arm of the tuned circuit and thereby varying capacitance instead of inductance. This technique has been effective in maintaining constant Q, as the tuned circuit is set at the precise design center frequency. However, the manufacture of these tuned circuits is a problem, since it requires substantial skill on the part of the worker, and frequently too much of the capacitor is cut or filed away, which, of course, cannot be retrieved. Consequently, the damaged capacitor must be replaced, and the filing of the capacitor started over again for tuning the circuit.

Generally, toroids are used in the inductive arm of very high Q circuits. To vary the inductance, a variable coil is often connected in series with the toroid coil. The variable coil is physically placed in the circuit spaced from the toroid. However, upon adjustment of the variable coil, the Q of the tuned circuit usually varies appreciably over the adjustment range of the variable coil. Thus, due to the variation in Q upon adjusting the inductance in the circuit, the advantage of using a toroid coil was, heretofore, substantially reduced. When it was critical to utilize the high Q characteristic of the toroid coil, the variable coil was not used, but instead the capacitor was trimmed for tuning the circuit, as aforedescribed.

SUMMARY OF INVENTION

The subject invention provides a tunable coil assembly which fully utilizes the high Q characteristic of the toroid coil. A cylindrical coil form is attached to the toroid core. A cylindrical core is movable within the form for varying the inductance of the coil assembly. A plurality of windings are each wound around both the form and the toroid core, and other windings are wound around only the toroid core. By properly setting the ratio of the total windings to the windings wound around both the toroid and the cylindrical form, the optimum range for inductance adjustment with acceptable, if any, variation in Q, may be achieved for easily and precisely tuning the filter.

It is therefore a primary object to provide a tunable coil having a wide adjustment range for inductance, without causing any appreciable variation in the Q of the coil over the range.

It is another object to provide a tunable coil including a toroid core.

It is another object to provide a tunable coil having a high Q over the entire adjustment range.

It is a feature of the subject invention to provide a tunable coil including a toroid core and a cylindrical core movable within a cylindrical coil form. Another feature is to secure the coil form to the toroid core.

Still another feature is to provide a tunable coil having at least one turn wound around both a cylindrical coil form and a toroid core.

Still another feature is to provide a tunable coil including a powdered iron toroid core and a powdered iron slug movable within a coil form constructed from an electrically insulative material.

BRIEF DESCRIPTION OF THE DRAWING

Referring to the drawing in which the same characters are employed to indicate corresponding or similar parts throughout the several figures of the drawing.

DESCRIPTION OF THE PREFERRED EMBODIMENT

Figure 1:
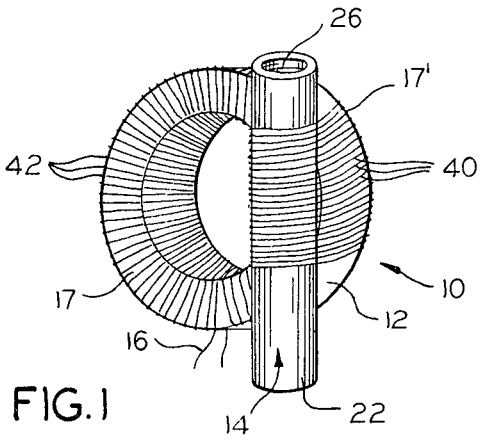
FIG. 1 is a perspective view of a tunable coil assembly, embodying the principles of the invention.
Figure 2:
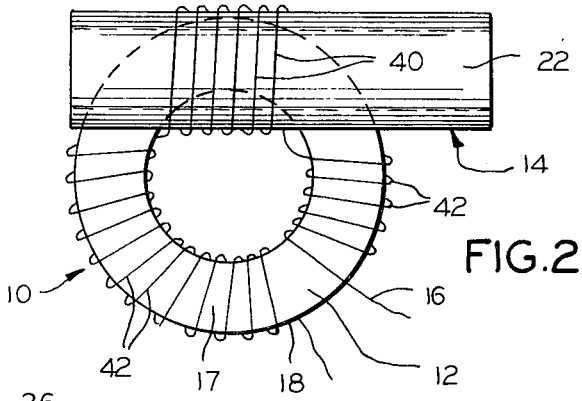
FIG. 2 is a front view of the tunable coil assembly.
Figure 4:
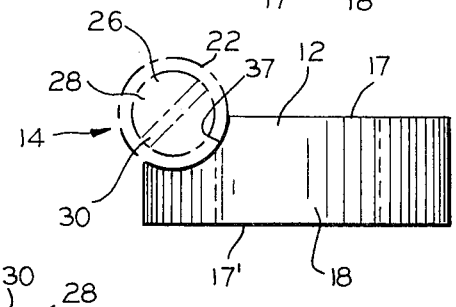
FIG. 4 is an edge view of the toroid core and showing the movable slug and holder in phantom.
Figure 3:
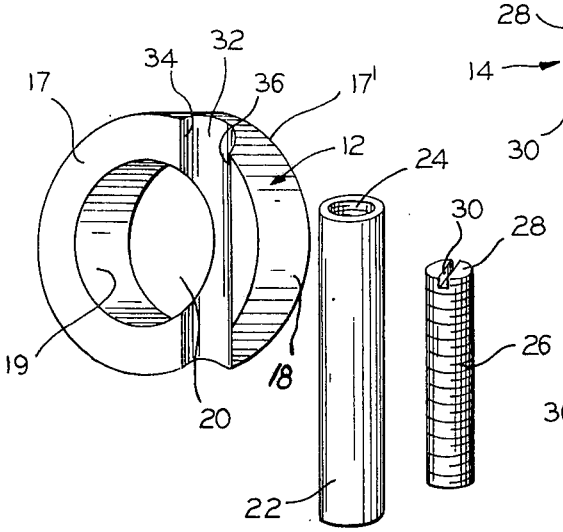
FIG. 3 is an exploded perspective view, showing the core holder spaced from the toroid core and the movable slug removed from the holder.
Figure 5:
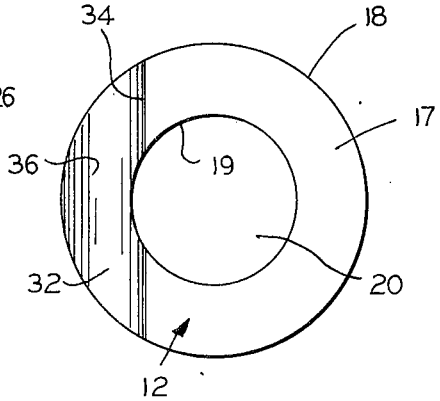
FIG. 5 is a top view of the toroid core.

Referring now to FIGS. 1 and 2 of the drawing, the reference numeral 10 indicates generally a tunable toroid coil assembly comprising a toroid or ring core 12, an adjustable core means 14 attached to the toroid core 12, and an electrically conductive wire identified generally by the reference numeral 16 wound around the toroid core 12 and the adjustable core means 14.

The toroid core 12 has a doughnut or ring shape and includes a front face 17, a rear face 17', an outer ring edge 18, and an inner ring edge 19 defining a hollow circular cavity 20. The toroid 12 may be formed from powdered iron or a ferrite material, or other suitable material for providing the Q of the coil and the desired range of inductance.

The adjustable core means 14 includes a cylindrical coil form or holder 22 made from an electrically insulative material, preferably a ceramic or glass, although other materials may be equally as suitable. The inside 24 of holder 22 is threaded to receive a threaded cylindrical slug 26.

The slug 26 is also formed from powdered iron or a ferrite material or other suitable material. However, preferably the slug 26 is formed from the same material as the toroid core 12. The slug 26 includes a head 28 having a notch 30 for receiving a screw driver (not shown).

An elongated concave groove 32 is formed inward from the front face 17 of the toroid 12, having an inner concave side 34 and an outer concave side 36. The cylindrical holder 22 is positioned inside the groove 32 between the sides 34, 36. A thin layer 37 of cement or a bond type glue or adhesive is used for fixidly securing the holder 22 inside the groove 32.

As shown in FIGS. 1 and 2, the wire 16 includes a set of turns 40, and each turn 40 is wound around both the adjustable core means 14 and the toroid core 12. Another set of turns 42 is wound only around the toroid core 12.

The range for varying the inductance of the coil assembly 10 is determined by the ratio of total turns of wire 16, which includes the sum of turns 40 and turns 42, to the number of turns 40. Therefore, if the total turns are 35 and 10 turns 40 are wound around both the form 22 and the toroid 12, the ratio is 3.5.

The more turns 40 around the form 22 with respect to the total turns, the greater is the tunability of the coil assembly 10. Conversely, less turns 40 around the form 22 with respect to the total turns, the tunability is less. However, the greater the tunability of the coil assembly 10 (more turns 40), the greater is the variation of Q over the tuned range; and the less the tunability (less turns 40), the less is the variation of Q over the tuned range.

Thus, by optimizing the ratio of total turns 40 and 42 to the turns 40 (around the form 22) adequate tunability with minimal or no appreciable variation in Q over the tuned range, could be achieved.

It has been found that by providing a ratio between 2 and 4 for the turns 40 with respect to the total turns 40 and 42, adequate tuning and minimal variation in Q is obtained. For the lower ratio of 2 the Q variation is the greatest over the tuning range, and at the high ratio of 4 the Q is relatively constant over the tuned range. For a powdered iron toroid core 12 and a powdered iron slug 26, it has been found that a ratio of 3.5 is optimum for providing a sufficient tuning range and minimal Q variation.

Figure 7:
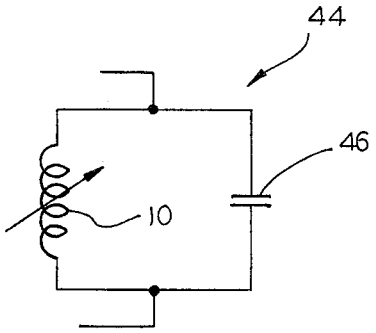
FIG. 7 illustrates a simple "L—C" tuned circuit utilizing the tunable coil assembly.
Figure 6:
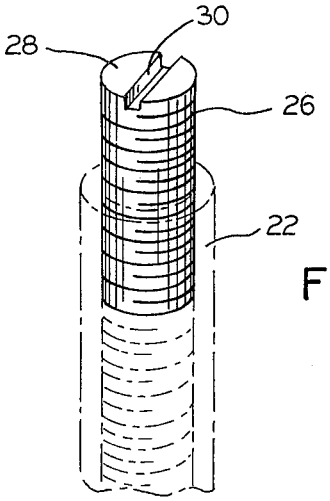
FIG. 6 is a fragmentary perspective view of the movable slug and showing the holder in phantom.

Turning now specifically to FIG. 7, a simple L-C filter section 44 is shown to illustrate an example circuit for the use of the tunable coil assembly 10 of the subject invention. Section 44 includes the tunable coil assembly 10 in parallel with capacitor 46. A plurality of filter sections 44 may be connected in parallel to increase the quality or sharpness of the response curve or flatten out the pass or rejection band between the 3 db points of the response curve.

Although the groove 32 is formed in the toroid core 12 to provide a firm seat for the coil form 22, the coil form may be fixidly attached directly to the flat face 17 or 17' or to the outer edge 18 of the toroid 12. Alternatively, instead of the slug 26 being threaded a threaded bar may be attached to the slug.

Therefore, to vary the inductance of the tunable coil 10, the slug 26 is moved inward or outward from the holder 22. The stability of the Q over the adjustment range will depend upon the ratio of the total turns and the turns around the adjustable core means 14.

The description of the preferred embodiment of this invention is intended merely as illustrative of this invention, the scope and limits of which are set forth in the following claims.

I claim:

1. A tunable core assembly on which an electrically conductive wire is wound, comprising:

a primary toroidal, magnetic, continuous core having an opening therethrough;

an adjustable magnetic core means including a hollow holder attached to the outside of the primary core and a tuning slug movable inside said holder, said wire including at least one turn extending through said opening and being wound around and in contact with said primary core and the outside of the holder, said adjustable core means not extending into or through said opening.

2. The tunable core assembly of claim 1, wherein:

said primary core includes a continuous outer ring and a continuous inner ring defining said opening, a front face and an opposed rear face for linking said outer and inner rings, said holder being attached to said front face.

3. The core assembly of claim 1 includes:

said slug being movable along a plane angular with respect to the plane passing through said turn, the distance from the portion of the slug inside said turn to the inside surface of the turn being unchanged as the slug position is varied.

4. The core assembly of claim 1, wherein said primary core includes a front face and an opposed rear face linking an outer rim and an inner rim, said inner rim defining said opening;

said adjustable core means attached to the front face of the primary core, the distance between the adjustable core means and a plane passing through the rear face being unchanged as the adjustment means is varied.

5. The core assembly of claim 1, wherein said primary core and said slug are formed from the same material.

6. The core assembly of claim 1, wherein said holder is formed from an electrically insulative material.

7. The core assembly of claim 1, wherein a groove is formed in the primary core receiving said holder.

8. The core assembly of claim 7, wherein said holder is convex and said groove is concave receiving the holder.

9. The core assembly of claim 2 includes adhesive means bonding the holder to the primary core.

10. The core assembly of claim 1 includes:

at least one turn of said wire extending around the primary core; and said at least one turn of said wire extending around said adjustable core means and said primary core.

11. The core assembly of claim 1, wherein a groove is formed in the primary core receiving said adjustable core means.

12. The core assembly of claim 1, wherein said primary core is a toroid having an outer ring edge and an inner ring edge and a pair of opposed faces linked together by said edges; and a groove is formed inward from one of said faces receiving said adjustable core means.

13. The core assembly of claim 1, wherein the ratio of total turns of said electrical wire around the tunable core assembly to the turns of said electrical wire only around both the primary core and the adjustable core is greater than 2 but not greater than 4.

14. The core assembly of claim 13, wherein said ratio is approximately 3.5.

15. The core assembly of claim 11, wherein said groove includes an inner side and an outer side, said holder being positioned in the groove between said sides.

16. The core assembly of claim 1, wherein said holder includes internal threads and said slug includes external threads to provide rotatable movement inside the holder.

17. The core assembly of claim 1, wherein said primary core is a toroid shape; and said hollow holder is cylindrically shaped and is formed from an electrically insulative material; and said slug is movable inside said holder, for precisely setting the inductance provided by the combination of the core assembly and the wire, the toroid and the slug being formed from substantially the same material.

18. The core assembly of claim 5, wherein the primary core and the slug are formed from powdered iron.

* * * * *